US008910600B2

(12) United States Patent
Boegershausen et al.

(10) Patent No.: US 8,910,600 B2
(45) Date of Patent: Dec. 16, 2014

(54) PRESSURE STORAGE UNIT FOR A CAMSHAFT AND PISTON FOR A PRESSURE STORAGE UNIT

(75) Inventors: Mathias Boegershausen, Erlangen (DE); Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 92 days.

(21) Appl. No.: 13/419,534

(22) Filed: Mar. 14, 2012

(65) Prior Publication Data

US 2012/0234271 A1 Sep. 20, 2012

(30) Foreign Application Priority Data

Mar. 14, 2011 (DE) ..... 10 2011 005 472

(51) Int. Cl.

| | |
|---|---|
| ***F01L 9/02*** | (2006.01) |
| ***F01L 1/047*** | (2006.01) |
| ***F15B 1/04*** | (2006.01) |
| *F01L 1/344* | (2006.01) |

(52) U.S. Cl.

CPC ..... *F01L 1/047* (2013.01); *F01L 2001/34446* (2013.01); *F15B 2201/61* (2013.01); *F15B 2201/31* (2013.01); *F15B 2201/605* (2013.01); *F15B 2201/21* (2013.01); *F01L 2001/0471* (2013.01); *F15B 1/04* (2013.01)

USPC ..... 123/90.12; 123/90.17

(58) Field of Classification Search

CPC ..... F01L 2001/34446

USPC ..... 123/90.12, 90.15, 90.17, 90.33, 90.34, 123/90.6; 29/888.1; 74/567; 477/145; 92/172

See application file for complete search history.

(56) References Cited

U.S. PATENT DOCUMENTS

| | | | | |
|---|---|---|---|---|
| 5,186,129 | A * | 2/1993 | Magnan et al. | 123/90.34 |
| 6,782,856 | B2 * | 8/2004 | Aimone | 123/90.34 |
| 6,899,211 | B2 * | 5/2005 | Carne | 192/85.63 |
| 7,597,076 | B2 * | 10/2009 | Strauss et al. | 123/90.17 |
| 2009/0064674 | A1 * | 3/2009 | Davidsson | 60/422 |
| 2009/0199796 | A1 * | 8/2009 | Hisada et al. | 123/90.12 |

FOREIGN PATENT DOCUMENTS

| | | |
|---|---|---|
| DE | 202005008264 | 9/2005 |
| DE | 102005013141 | 9/2006 |
| EP | 1596040 | 11/2005 |
| WO | 2006039966 | 4/2006 |
| WO | WO 2008140897 A1 * | 11/2008 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A pressure storage unit (2) for a camshaft, having an integrated controllable pressure storage device for supporting hydraulic engine components, which includes a housing (4) with a piston (14) mounted movably therein having a piston floor (18), and a spacer element (28) being provided on the piston floor (18).

8 Claims, 2 Drawing Sheets

8
12
10
18
24
III
28
14
10
20
26
34
22
30
2
4
16
32
62
64
66
64
66
54
60
52
46
58
48
56
50
6
2
4
16

PRESSURE STORAGE UNIT FOR A CAMSHAFT AND PISTON FOR A PRESSURE STORAGE UNIT

CROSS-REFERENCE TO RELATED APPLICATIONS

This application claims the benefit of German Patent Application 102011005472.3, filed Mar. 14, 2011, which is incorporated herein by reference as if fully set forth.

FIELD OF THE INVENTION

The present invention relates to a pressure storage unit for a camshaft, having an integrated controllable pressure storage device for supporting hydraulic engine components comprising a housing with a piston mounted movably therein. The present invention further relates to a piston for a corresponding pressure storage unit.

BACKGROUND OF THE INVENTION

A controllable or switchable pressure storage device of this type is used to ensure proper functioning of, or to improve the response characteristic of, hydraulic components in an engine, to which components oil pressure must be available in as short a time as possible in particular when starting the engine. This can for example be a hydraulic camshaft phaser or a supply unit for supplying oil under pressure to the camshaft bearing points in the cylinder head. Hydraulic camshaft phasers are described for example in the following publications of applicant: DE 20 2005 008 264 U1, EP 1 596 040 A2, DE 10 2005 013 141 A1, and WO 2006/039966. The demands on the pressurized oil supply stated here hold in particular for engines of vehicles having a start-stop system, or in engines in which, in hot idling operation, the supply of pressurized oil without a pressure storage device is not sufficiently ensured in all operating states.

In the German patent application originating from applicant and not yet published at the time of application, and having official file number 10 2009 054 052.0, a pressure storage device is disclosed that is placed in a hollow space inside a camshaft. On the basis of such an integrated construction, the required constructive space for a corresponding engine can be reduced in comparison with a design having a storage device situated separately, i.e. situated outside the camshaft.

An alternative embodiment of an integrated pressure storage device is described in the German patent application, also originating from applicant and not yet published at the time of application, having official file number 10 2010 063 390.9.

SUMMARY

Against this background, the present invention is based on the object of providing an improved integrated switchable pressure storage device.

This object is achieved according to the present invention by a pressure storage unit having the features of the invention. Further developments of the present invention, some of which are advantageous and some of which are inventive in their own right, are provided below and in the claims.

The pressure storage unit has a housing having a piston mounted so as to be movable therein. This housing is for example provided by the walls of a hollow space made in a camshaft. Preferably, however, the housing is fashioned as a separate component in the manner of a cylindrical cartridge.

In both cases, the housing acts as a carrier element for the remaining components of the pressure storage unit. In the case of the embodiment of the housing as a cartridge, the pressure storage unit is placed into a corresponding hollow space of a camshaft during a final assembly stage.

A segment of the housing and of the piston together form a hydraulic cylinder, with the aid of which oil pressure is built up as needed in a connected hydraulic system, so that, for a limited time period, a supply is ensured of oil under pressure to hydraulic components that are fluidically connected to the hydraulic system. Inside the hydraulic cylinder, and preferably on the floor of the piston, a spacer element is provided that prevents the piston floor from coming into contact with the oppositely situated wall of the hydraulic cylinder, hereinafter called the cylinder floor. Without such a spacer element, the piston floor and the cylinder floor will come into contact with one another in an initial position. Both floors typically have flat partial surfaces, which in the operating state are at least wetted with an oil, and which lie against one another in the initial position. Correspondingly, the piston floor, and thus the piston, adheres to the cylinder floor, so that an increased application of force is necessary to displace the piston from its initial position. In contrast, this is avoided with the use of the spacer element.

Preferably, the spacer element is annular in construction. In this way, inter alia it is possible to make use of an existing assortment of parts, such that for example a sealing ring or a washer may be used as a spacer element.

In a preferred embodiment, the piston has a multi-part construction and includes a sleeve element as a piston skirt, as well as including the piston floor accommodated in the sleeve body. The individual parts of the piston are in particular manufactured by shaping, so that their production is simple and economically advantageous.

In this context, it is in addition useful that a first end segment of the sleeve body acts as an annular spacer element. Correspondingly, no additional component is provided for the formation of the spacer element, which makes production simpler.

In addition, an embodiment is preferred in which a second end segment, situated opposite the first end segment, of the sleeve body has a smaller radial extension in order to form a stop in the stroke direction. Here, the second end segment is made in the region of the stop so as to be in particular rotationally symmetrical to the center longitudinal axis of the sleeve body, and acts as a stop for a cylindrical helical spring. As a result of this design, it is for example possible to introduce a provided cylindrical helical spring through the wall of the housing even in the area of the stop.

In a useful development, a radial expansion is provided for the second end segment of the sleeve body that varies in the stroke direction in order to form a rear-engaging element, such that going out from the piston floor the radial expansion first decreases and then increases again in a following segment. The sleeve body thus takes over a plurality of functions without requiring additional manufacturing steps in its shaping.

In addition, it is regarded as advantageous if the piston has a multi-part construction and includes a bowl-shaped body, the floor of the bowl-shaped body acting as piston floor. The bowl-shaped body is accommodated by the piston skirt. A bowl shape in which the bowl height is at least ¼ the bowl diameter is particularly preferred. Together with the bowl wall, in the shape of a cylindrical casing, this forms a sufficient surface via which the forces acting on the bowl floor can also be redistributed to the sleeve body.

In addition, it is advantageous, taking into account the locally occurring forces that are to be expected, to provide a smaller wall thickness for the bowl-shaped body than for the sleeve body. This for example reduces the material requirement, and achieves a savings of weight.

In addition, it is useful to connect at least two parts of the multi-part piston, in particular the sleeve body and the bowl-shaped body, by a press-fit connection. This method is distinguished by very simple realization and therefore low cost.

BRIEF DESCRIPTION OF THE DRAWINGS

In the following, the present invention is explained in more detail on the basis of the drawings.

DETAILED DESCRIPTION OF THE PREFERRED EMBODIMENTS

Figures 1, 2:
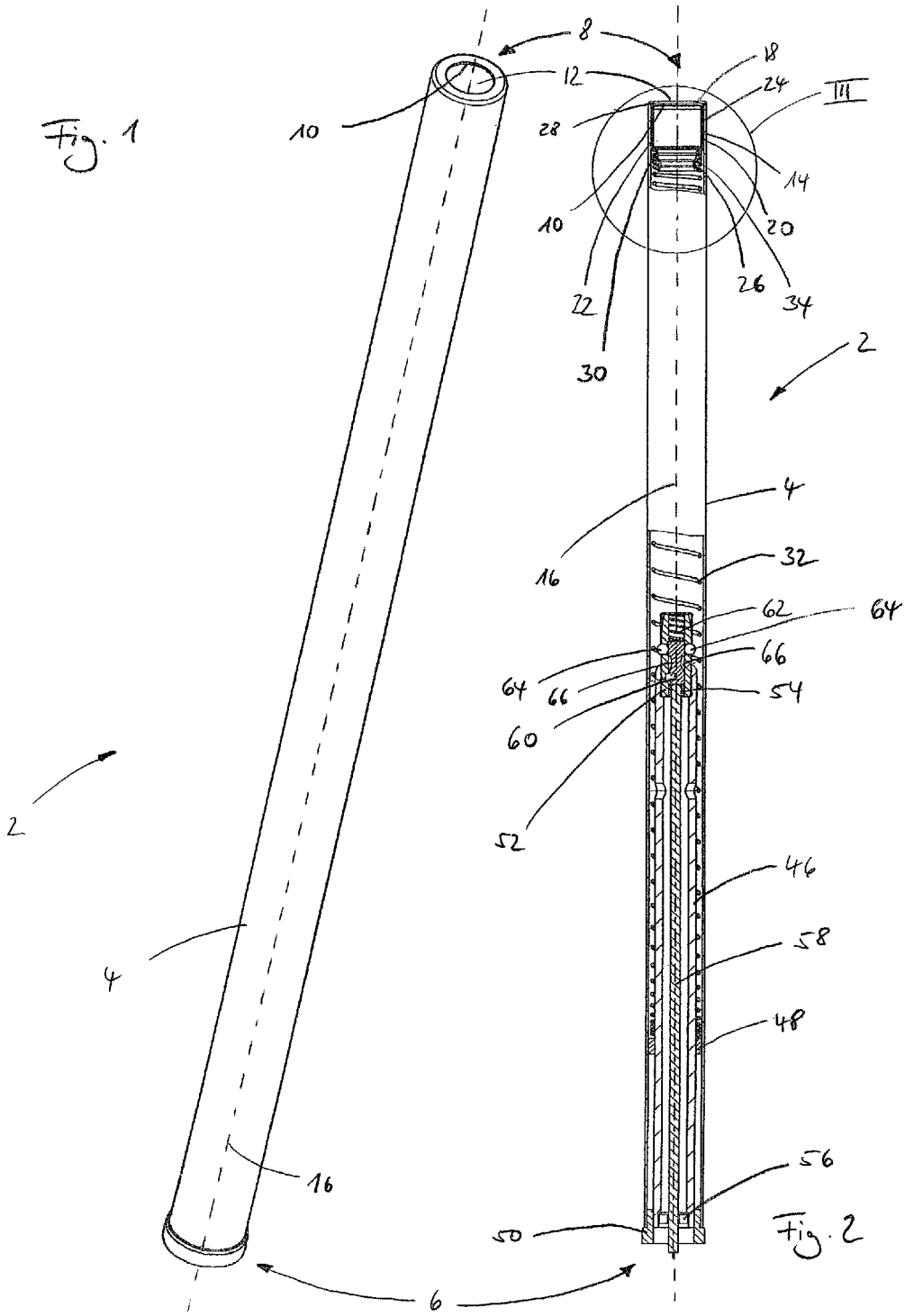
FIG. 1 shows a side view of a pressure storage unit.
FIG. 2 shows the pressure storage unit in longitudinal section.

In all Figures, corresponding parts have been provided with the same reference characters.

A pressure storage unit 2, described below, is in particular a development of the pressure storage device described in the application having official file number 10 2010 063 390.9. Incorporation by reference is therefore expressly made to the entire disclosure of said document, which originates from applicant.

The pressure storage unit 2 is shown in FIG. 1 in a perspective side view. Here, a cylindrical cartridge is used as a housing 4, and is placed into a hollow space of a camshaft during a final assembly stage. In the final assembled state, the lower end (in the Figure) of the housing 4 is connected (in a manner not further shown) to an actuator with the aid of which the pressure storage unit 2 is controlled. Opposite the housing end, also referred to as the actuator end 6 hereinafter, there is situated a connecting end 8 of the housing 4. Via this end, the housing 4 is connected to a hydraulic network (not shown) for whose proper functioning the pressure storage unit 2 is provided. This connecting end 8 is here essentially provided by a disk-shaped housing floor 10, in the center of which a circular opening 12 has been made.

The supply pressure in the hydraulic network is manipulated using a hydraulic cylinder that is provided on the one hand by the connecting end 8 and by the cylinder casing, connected immediately thereto, of the housing 4, and on the other hand by a piston 14 placed therein. The piston 14 is mounted in the housing 4 so as to be movable in the direction of a center longitudinal axis 16 of the pressure storage unit 2, so that in the region between the piston floor 18 and the housing floor 10 a pressure chamber having a variable volume is formed for a lubricant such as hydraulic oil.

According to the exemplary embodiment, a two-part construction is provided for the piston 14. A cup-shaped or bowl-shaped body 20, in which the ratio of bowl height to bowl diameter in the exemplary embodiment is approximately 1:1, is used here as the piston base 18. the bowl-shaped body 20 is accommodated in a sleeve body 22 that has a hollow cylindrical partial segment, referred to as piston skirt 24, as well as a contoured locking segment 26 connected thereto. The greater the expansion of the piston skirt 24 in the direction of the center longitudinal axis 16, the less is the quantity of lubricant and hydraulic oil that seeps out, as leakage between the housing inner wall and the piston skirt 24, from the hydraulic cylinder in the direction of the actuator end 6. In the finally assembled state, the bowl-shaped body 20 is situated in the sleeve body 22 and is connected thereto by a press-fit connection. The components are preferably manufactured by shaping, a smaller wall thickness being provided for the bowl-shaped body 20 than for the sleeve body 22. As a result, no relevant deformation of the sleeve body 22 occurs during the pressing of the bowl-shaped 20 into the sleeve body 22, so that the piston 14 does not have to be post-processed for correction after this working step.

In the finally assembled state, in the direction of the center longitudinal axis 16, the piston skirt 24 extends beyond the floor of the bowl-shaped body 20, which acts as the piston floor 18, so that an annular projection is formed in the region of the piston floor 18 by the piston skirt 24, with this projection acting as a spacer element 28 between the piston floor 18 and the housing floor 10. This spacer element 28 prevents the piston floor 18 from coming to lie against the housing floor 10, and thus prevents the piston 14 from adhering to the housing 4.

Without a corresponding spacer element 28, when there is corresponding displacement, the piston floor 18 and the housing floor 10 approach one another to an extent such that flat partial surfaces of both floors 10, 18 lie against one another in an essentially flat parallel fashion, the lubricant and/or hydraulic oil filling the remaining intermediate space to the largest possible extent, thus causing the typical disturbing adhesion effect in this context. In contrast to this, the undesired adhesion effect is kept low with the use of the annular spacer element 28, in that only the annular end surface of the piston skirt 24 lies on the housing floor 10 when there is corresponding displacement of the piston 14.

The locking segment 26, connected to the piston skirt 24, of the sleeve body 22 acts on the one hand as stop 30 for a cylindrical helical spring 32, and acts on the other hand as rear-engaging element 34 provided for the arresting of the piston 14 at a provided position inside the housing 4. This locking segment 26 is for this purpose fashioned so as to be, to a good approximation, rotationally symmetrical to the center longitudinal axis 16 of the piston 14, and has a radial expansion that varies in the direction of the center longitudinal axis 16.

Figure 3:
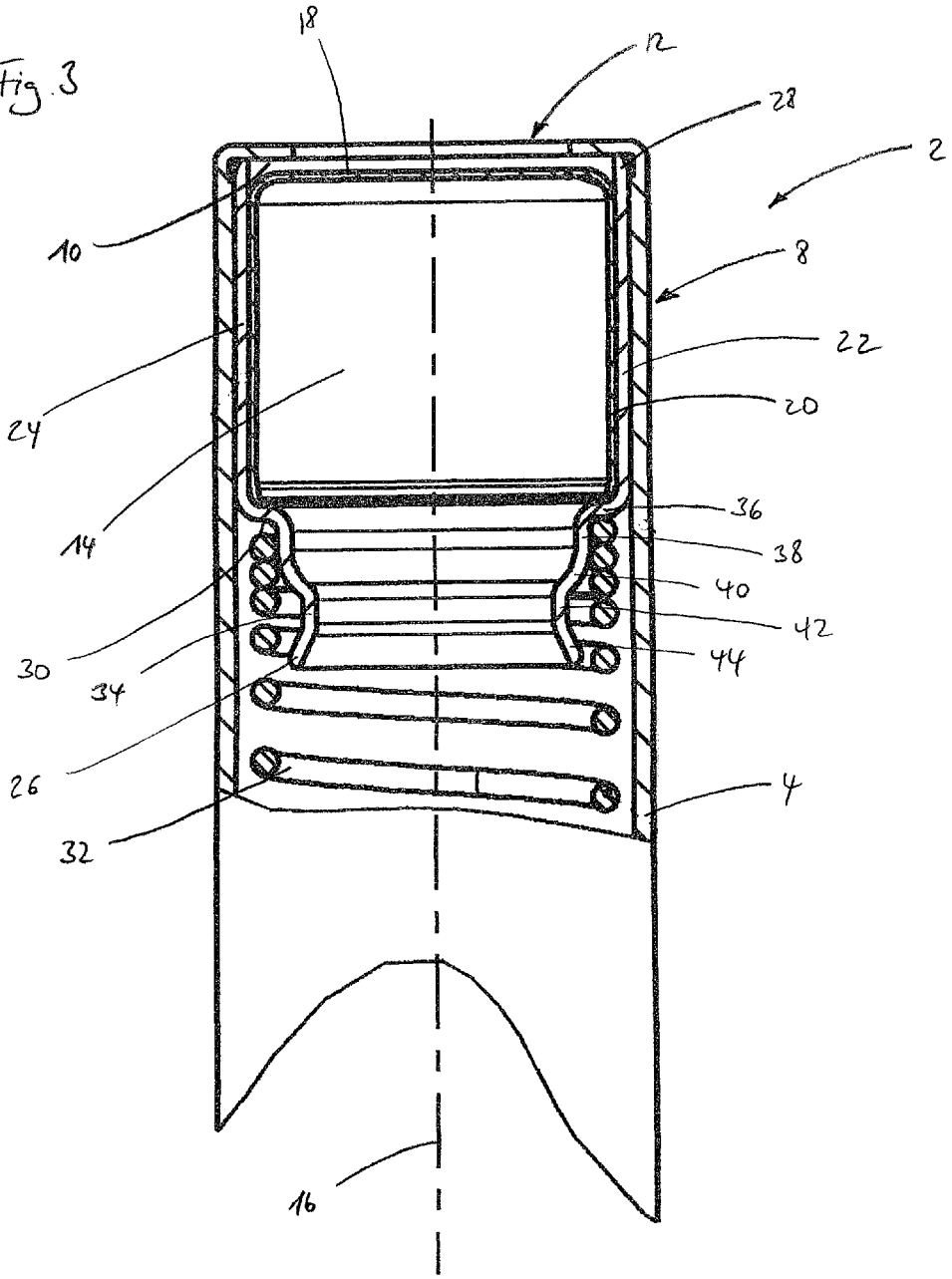
FIG. 3 shows the detail III according to FIG. 1 of the pressure storage unit.

The curve (shown in the sectional representation in FIG. 3) of the varying radial expansion can be described in a first approximation as W-shaped, said W-shaped curve being tilted relative to the center longitudinal axis 16. If this curve is regarded going out from the piston floor 18, following the piston skirt 24 there first follows a first partial segment in which the material wall of the locking segment 26 is guided essentially radially, i.e. in the direction toward the center longitudinal axis 16. To this there is in turn connected a second partial segment in which a nearly constant radial expansion is provided. Correspondingly, the first two partial segments of locking segment 16 form a nearly right-angled step that acts on the one hand as the axial stop 30 for the helical spring 32, and acts on the other hand to guide the helical spring 32 in the region between the locking segment 26 and the inner wall of the housing 4.

In its further course, i.e. in a third partial segment, the radial expansion of the locking segment 26 further decreases, remaining essentially constant in a following fourth partial segment, and finally increasing again in a fifth partial segment, such that the radial expansion at the end of the fifth partial segment corresponds approximately to the radial expansion of the second partial segment. The third, fourth, and fifth partial segments together form a kind of constriction in the locking segment 26 that forms a rear-engaging element 34.

The above-noted helical spring 32 is a component of a mechanism with the aid of which an axial movement, produced by an actuator, is used to control the piston 14 in the hydraulic cylinder. This mechanism is made up of a plurality of mechanical components placed between the piston 14 and the actuator end 6 in the housing 4. In addition to the helical spring 32, the mechanism includes a hollow cylindrical base element 46 that, with the aid of a positioning ring 48 and a sleeve 50 that forms the connecting end 8, is connected fixedly to the housing 4 and is situated in rotationally symmetrical fashion about the center longitudinal axis 16.

As can be seen in FIG. 2, the positioning ring 48 also functions as a second axial stop for the helical spring 32, which in the finally assembled state is thus pre-clamped between the positioning ring 48 and the piston 14, the spring resetting force of said spring acting on the piston 14 in such a way that said piston is pressed in the direction of the connecting end 9, if the pressure in the hydraulic system is left out of consideration.

At the end of the base element 46 facing the piston 14, there is positioned a likewise hollow cylindrical ball carrier 52, which is connected fixedly to the base element 46 such that the hollow cylinder end of ball carrier 52 engages in the hollow cylinder end of the base element 46. In the region of the engaging cylinder ends, an annular auxiliary bearing 54 is placed inside the ball carrier 52. This auxiliary bearing supplements a likewise annular bearing element 56 situated at the opposite end of the base element 46, inside said base element. The base element 46, the positioning ring 48, the sleeve 50, the auxiliary bearing 54, and the bearing element 56 together form a guide for a switching rod 58. This element lies in the guide and is movable along the center longitudinal axis 16.

The movement executed by the actuator along the center longitudinal axis 16 is forwarded via the switching rod 58 to a switching pin 60. The switching pin 60 is thus actively pushed against a switching spring 62, and is passively guided back by the switching spring 62 when the actuator action is retracted. This movement of the switching pin 60 along the center longitudinal axis 16 takes place between two support positions that, corresponding to their function, are designated the blocking position on the one hand and the release position on the other hand. In the release position, a number of ball-shaped blocking elements 64 lie at least partially in a circulating annular groove 66. In contrast thereto, in the blocking position blocking elements 62 are displaced radially outward.

If the piston 14 is now sufficiently displaced in the direction of the ball carrier 52 due to a prevailing pressure in the hydraulic network, the blocking position causes an arresting of the piston 14, and the rear-engaging element 34 of locking segment 26 engages the blocking elements 64 from behind. In this position of the piston 14, the helical spring 32 is tensioned beyond its pre-tension, and the energy that is to be applied for the tensioning of the helical spring 32 is mechanically stored due to the arresting. When the actuator is correspondingly actuated, the switching pin 60 is displaced in the direction of the center longitudinal axis 16 so that the blocking elements 64 escape radially inward, thus releasing the piston 14 and thus releasing the energy stored in the helical spring 32.

LIST OF REFERENCE CHARACTERS

2 pressure storage unit
4 housing
6 actuator end
8 connecting end
10 housing floor
12 circular opening
14 piston
16 center longitudinal axis
18 piston floor
20 bowl-shaped body
22 sleeve body
24 piston skirt
26 locking segment
28 spacer element
30 stop
32 helical spring
34 rear-engaging element
36 first partial segment
38 second partial segment
40 third partial segment
42 fourth partial segment
44 fifth partial segment
46 base element
48 positioning ring
50 sleeve
52 ball carrier
54 auxiliary bearing
56 bearing element
58 switching rod
60 switching pin
62 switching spring
64 blocking element
66 annular groove

The invention claimed is:

1. A pressure storage unit for a camshaft, comprising an integrated controllable pressure storage device for supporting hydraulic engine components having a housing with a piston mounted movably therein between an initial, uncharged position and a charged position, the piston including a piston floor, and a spacer element on the piston floor, in the initial, uncharged position the spacer element prevents the piston floor from contacting an oppositely situated housing floor, and in the charged position hydraulic fluid is supplied to a space between the housing floor and the piston floor, wherein the piston has a multi-part construction and includes a sleeve body as a piston skirt in which the piston floor is accommodated.

2. The pressure storage unit as recited in claim 1, wherein the spacer element has an annular construction.

3. The pressure storage unit as recited in claim 1, wherein a first end segment of the sleeve body is annular and forms the spacer element.

4. The pressure storage unit as recited in claim 3, wherein a second end segment of the sleeve body has a smaller radial expansion in order to form a stop in a stroke direction.

5. The pressure storage unit as recited in claim 1, wherein a second end segment of the sleeve body has a radial expansion that varies in a stroke direction in order to form a rear-engaging element, such that, going out from the piston floor, the radial expansion first decreases in the stroke direction, and increases again in a following segment.

6. The pressure storage unit as recited in claim 1, wherein the piston has a multi-part construction and includes a bowl-shaped body, a floor of the bowl-shaped body forms the piston floor.

7. The piston storage unit as recited in claim 6, wherein the piston includes a sleeve body as a piston skirt, and the bowl-shaped body has a smaller wall thickness than a wall thickness of the sleeve body.

8. The pressure storage unit as recited in claim 7, wherein at least two parts of the multi-part piston are connected to one another by a press-fit connection.

* * * * *